United States Patent [19]

Burgess et al.

[11] 4,238,550

[45] Dec. 9, 1980

[54] DUNNAGE BAR AND METHOD OF MAKING IT

[75] Inventors: Leonard G. Burgess, New Baltimore; Richard E. Wroblewski, Roseville, both of Mich.

[73] Assignee: Equipment Manufacturing, Inc., Warren, Mich.

[21] Appl. No.: 9,410

[22] Filed: Feb. 5, 1979

[51] Int. Cl.[3] ..... A47F 5/00

[52] U.S. Cl. ..... 428/586; 428/595; 428/598; 428/603; 211/162

[58] Field of Search ..... 428/586, 595, 598, 603; 211/162

[56] References Cited

U.S. PATENT DOCUMENTS

| | | | |
|---|---|---|---|
| 931,164 | 8/1909 | Vining | 428/595 |
| 1,054,105 | 2/1913 | Galbally | 428/595 |
| 2,055,771 | 9/1936 | McLaughlin | 428/595 |
| 2,791,017 | 5/1957 | Mulka | 428/595 |

*Primary Examiner*—Brooks H. Hunt
*Attorney, Agent, or Firm*—Joseph W. Farley

[57] ABSTRACT

A dunnage bar constructed from a single strip of sheet metal formed into a tubular, rectangular configuration having a working or load engaging face and an oppositely disposed base portion connected by a pair of parallel sides. The working face has a pair of walls which extend toward each other from the sides, are separated by a longitudinal slot, and are connected by a transverse web located inwardly of the slot. Each wall is composed of a double thickness of metal, each of the sides is a single thickness of metal, and the base portion also has double metal thicknesses which are interlocked with the sides along the edges of the base portion. The method of making the dunnage bar employs a plurality of stands of rolls through which the sheet metal strip is passed and is progressively formed from its center outward into the above-described configuration.

6 Claims, 8 Drawing Figures

DUNNAGE BAR AND METHOD OF MAKING IT

This invention relates to an improved construction for a dunnage bar used to position loads in a rack or other form of container for shipment, and to a method of making the dunnage bar from a strip of sheet metal by passing the strip through successive roll forming stages.

A dunnage bar of the type to which the invention pertains is in the form of a tubular beam, of generally rectangular shape in cross-section. The longer pair of parallel sides of the rectangle are the sides of the dunnage bar; the shorter pair become the base portion and the working face thereof, the term "workingface" designating the side of the dunnage bar which is placed adjacent to the load and which is provided with a longitudinal slot for attaching a buffer strip to the bar.

The improvements provided by the present invention to a dunnage bar of the foregoing type result in increasing the strength by balancing the amount of metal in the working face and base portions of the bar, and in decreasing the cost by forming the bar from a single strip of material in such a way as to require no welded seam and relatively simple tooling.

According to the improved construction of the invention, the working face, sides and base portion of a dunnage bar are formed from a single strip of sheet metal which is deformed so as to provide on the working face a pair of walls extending toward each other from the sides and separated by a longitudinal slot. Each of the walls is composed of a double thickness of sheet metal and the walls are connected by a transverse web disposed inwardly of the slot. Each of the sides is formed by a single thickness of sheet metal, and the base portion is formed by double thicknesses of sheet metal interlocked with the sides at the edges of the base portion.

The forming of the improved construction described above is carried out by passing the strip of sheet metal through a plurality of roll stands constructed and arranged to progressively form the strip from its longitudinal center outward to its edges into the configuration of the dunnage bar.

The features and advantages of the invention will be further explained in the description to follow of the presently preferred dunnage bar construction and method of making it shown in the accompanying drawings.

DESCRIPTION OF THE PREFERRED EMBODIMENT

Figure 1:
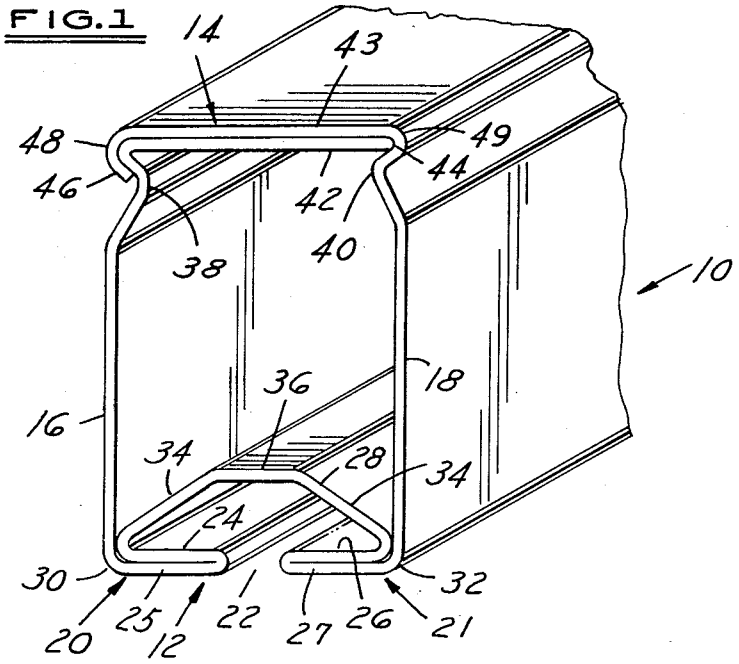
FIG. 1 is a sectional isometric view showing a portion of a dunnage bar of the invention.

A sheet metal dunnage bar 10 constructed in accordance with the present invention is shown in FIG. 1 and is of tubular, quadrilateral configuration having a working face 12, an oppositely disposed base portion 14 and a pair of parallel sides 16 and 18 connecting the working face 12 and base portion 14.

The working face 12 is designed to be positioned adjacent to a load; and, it includes a pair of walls 20 and 21 which extend toward each other from the sides 16 and 18 and which are separated from each other by a longitudinal slot 22. A load-engaging buffer member (not shown), such as a T-section rubber extrusion, is mountable in the slot 22. Each of the walls 20 and 21 is formed by a double thickness of sheet metal identified by the reference numbers 24 and 25 for the wall 20 and by the reference numbers 26 and 27 for the wall 21. A transverse web 28, disposed inwardly of the slot 22, connects the walls 20 and 21 and extends from the junction or corner 30 between the wall 20 and the side 16 to the junction or corner 32 between the wall 21 and the side 18. The web 28 is formed with portions 34 extending obliquely inwardly from the corners 30 and 32 and with a medial portion 36 disposed parallel to the working face 12.

Each of the sides 16 and 18 consists of a single thickness of sheet metal. Indentations 38 in the side 16 and 40 in the side 18 are formed adjacent to the side edges of the base portion 14, which consists of double thicknesses of sheet metal 42 and 43. The end 44 of the thickness 42 is clinched in the indentation 40; and, the thickness 43 has a lip 46 which is formed into the indentation 38, thus interlocking the thicknesses 42 and 43 in surface-to-surface contact at the side edges 48 and 49 of the base portion 14.

Figure 2:
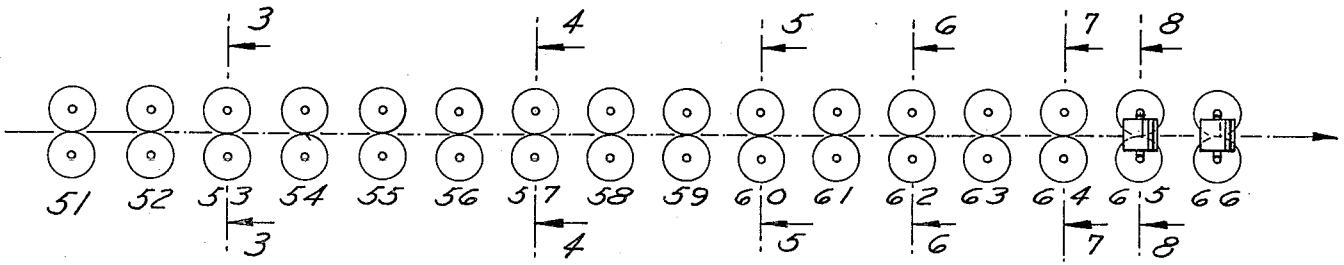
FIG. 2 is an elevation schematically illutrating the forming of the dunnage bar of FIG. 1 from a strip of sheet metal; and, FIGS. 3, 4, 5, 6, 7 and 8 are sectional elevations taken respectively on the lines 3–3, 4–4, 5–5, 6–6, 7–7, and 8–8 of FIG. 2 showing progressive stages in the formation of the dunnage bar of FIG. 1.

FIG. 2 schematically illustrates the method of forming the dunnage bar 10 from a single strip of sheet metal by passing the strip through successive roll stands numbered 51 through 66, and progressive stages in the formation process are shown in the sectional views, FIGS. 3—8. Each roll stand has not been shown in detail, as it is believed that the construction thereof will be evident to one skilled in the art from the progression apparent in the stages shown.

The formation process begins with the feeding of a strip 68 of sheet metal to the first stand 51. For example, the strip may be 14 gage hot rolled steel having an average thickness of about 0.080 inch, and a width of 14.90 inches for making the dunnage bar 10 with overall dimensions of two inches on the working face 12 and base portion 14 and three inches on the sides 16 and 18.

Figure 3:
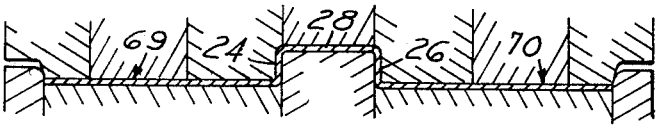

FIG. 3 illustrates the first stage of the process. The central portion of the strip 68 has been progressively formed, in passing through the stands 51–53, into a channel-shaped section having sides (which will become the inner thicknesses 24 and 26 of the working face 12 and are so designated) perpendicular to the side portions 69 and 70 of the strip and a base (which will become the transverse web 28 and is so designated) parallel to the side portions 69 and 70.

Figure 4:
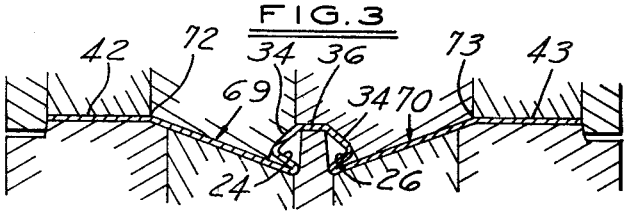

FIG. 4 illustrates the second stage of the process. The sides 24 and 26 of the channel section have been progressively bent inwardly toward each other and into overlapping relation with the adjacent side portions 69 and 70. Simultaneously, the base portion of the channel section has been formed to the general configuration of the portions 34 and 36 of the transverse web 28; and, demarking bends 72 and 73 have been created inwardly from the side edges of the strip at distances approximating the width of the base portions 14 of the dunnage bar 10. The strip of material between the bend 72 and the left side edge of the strip will become the inner thickness 42 and the strip of material between the bend 73 and the right side edge will become the outer thickness 43 of the base portion 14.

Figure 5:
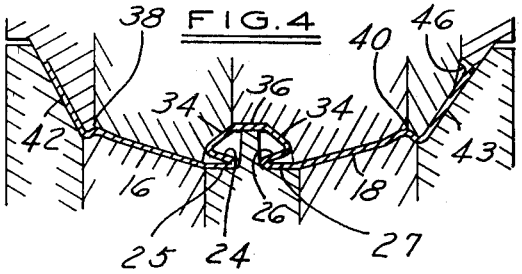

The third stage of the process appears in FIG. 5. Progressively, there have been formed the lip 46 along the right side edge of the strip and the indentations 38 and 40 at the location of the demarking bends, while the portions 42 and 43 between the indentations 38 and 40 and the side edges of the strip have been bent toward each other. Also, bends 74 and 75 have been created to define the sides 16 and 18 of the dunnage bar 10 and the outer thicknesses 25 and 27 of the walls 20 and 21.

Figure 6:
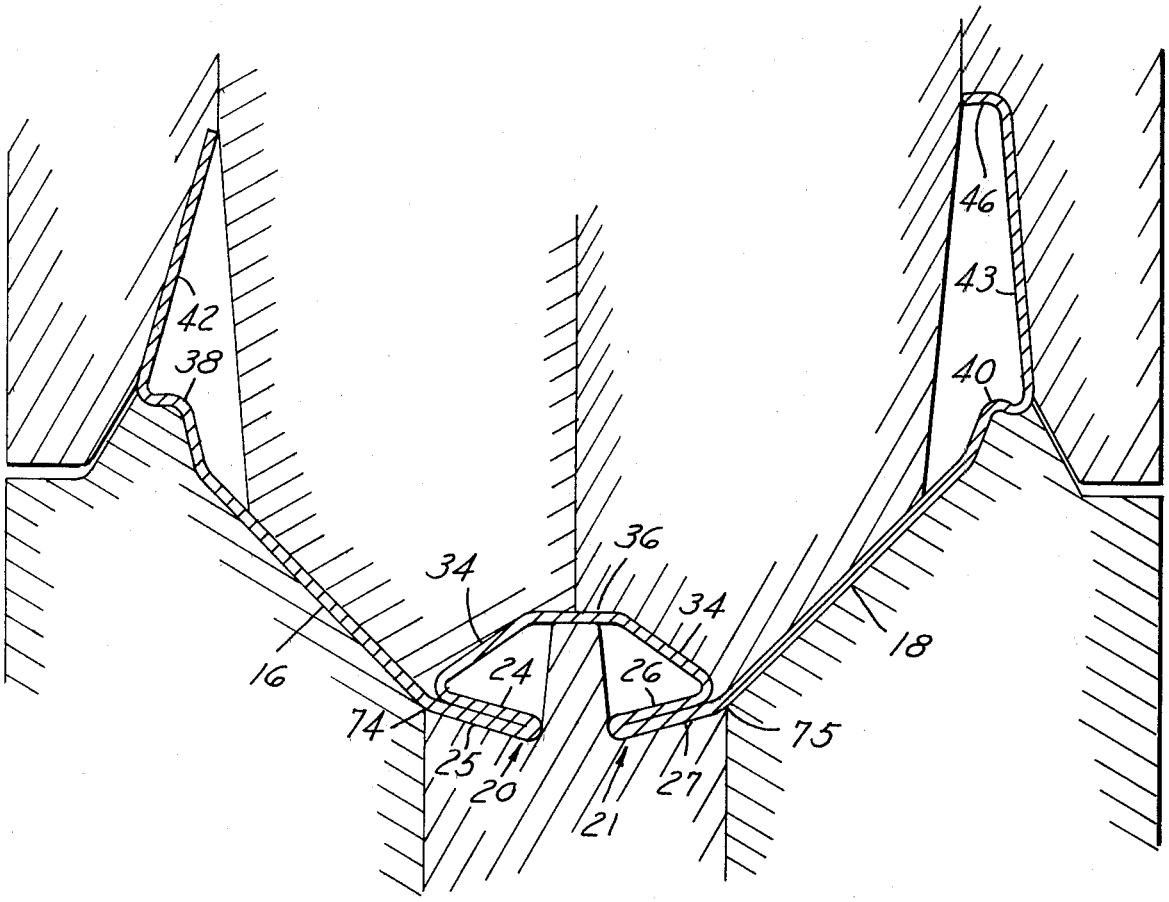

In FIG. 6, the fourth stage of the process, the sides of the channel-shaped section (inner thickness 24 and 26) and the adjacent side portions of the strip (outer thicknesses 25 and 27) have been folded into surface-to-surface engagement to form the pair of walls 20 and 21 and the slot 22 on the working face 12 of the dunnage bar 10. Simultaneously, the sides 16 and 18 and the inner and outer thicknesses 42 and 43 have been progressively bent towards each other.

Figure 7:
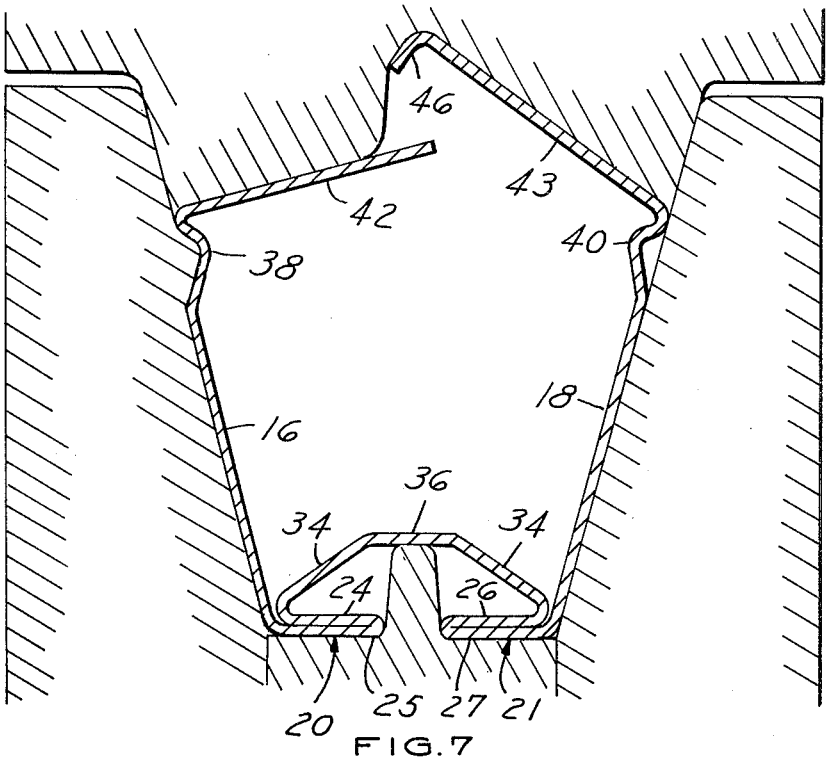
Figure 8:
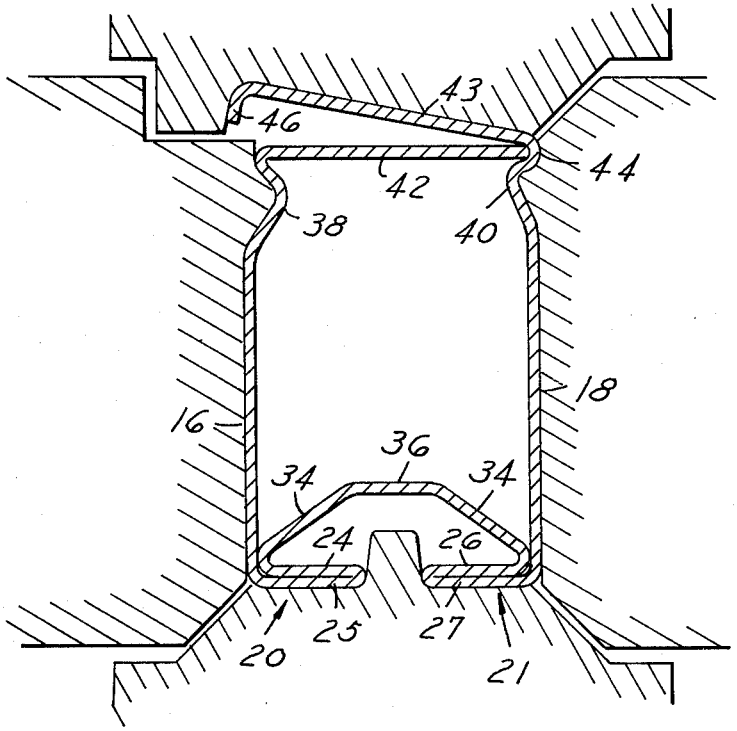

This progressive bending of the sides 16 and 18 toward positions of perpendicular relation to the pair of walls 20 and 21 has been continued in the next stage shown in FIG. 7, as has a continuation of the bending of the inner and outer thicknesses 42 and 43 toward each other. The outer thickness 43 has been overlapped with the inner thickness. When the sides 16 and 18 become perpendicular to the walls 20 and 21, as shown in FIG. 8, the end 44 of the inner base thickness 42 enters and is clinched in the indentation 40; and, the final step is to interlock the lip 46 on the edge of the outer base thickness 43 into the other indentation 38, thus forming the double thickness base portion 14 and the sectional configuration of the dunnage bar 10 shown in FIG. 1.

All of the stands 51–66 schematically shown in FIG. 2 consist of upper rolls and lower rolls mounted on upper and lower parallel horizontal axes, except for the last two stands 65 and 66 each of which also includes side rolls mounted on vertical axes. The edge profiles of the rolls are shown in the sectional views FIGS. 3–8 as are the dividing lines between adjacent upper rolls and adjacent lower rolls. FIG. 8 shows the relative orientation of the horizontally mounted upper and lower rolls and the vertically mounted side rolls of the stand 65, and it will be understood that a similar arrangement of horizontally and vertically mounted rolls is employed in stand 66 for the final forming, clinching and interlocking operations. It is not believed to be necessary for an understanding and practicing of the present invention to further identify and describe the rolls, as their construction and arrangement flows from the concept of forming the strip of sheet metal 68 progressively from its center into the relatively intricate sectional construction of the dunnage bar 10.

This construction and the method by which it is made provides important commercial and practical advantages. The one-piece construction in which the edges of the strip 68 are clinched and interlocked eliminates the welding of any seam, thereby reducing costs; the sectional configuration in which the working face 12 and the base portion 14 are each formed with double thicknesses of metal balances the amount of material in these portions of the dunnage bar 10 and increases its strength as a beam; this increased strength is obtained with a minimum amount of metal because of the single thickness employed in the sides 16 and 18, hence, for a given strength the dunnage bar 10 is lighter and requires less material than competitive dunnage bars presently available; and the method of making the dunnage bar requires a minimum number of roll stands because of the concept of progressive forming from the center of the strip 68 of sheet metal.

What is claimed is:

1. A sheet metal dunnage bar of tubular, rectangular configuration having a working face, an oppositely disposed base portion and a pair of generally parallel sides connecting the working face and base portion; said working face, sides and base portion being formed from a single strip of sheet metal deformed so as to provide on said working face a pair of walls extending toward each other from the sides and separated by a longitudinal slot; each of said walls being composed of a double thickness of said strip and said walls being connected by a transverse web disposed inwardly of said slot; each of said sides being formed by a single thickness of said strip; and said base portion being formed by double thicknesses of said strip having ends interlocked with the sides at the edges of said base portion.

2. A sheet metal dunnage bar according to claim 1, wherein said base portion is formed by the opposite marginal portions of said strip interlocked in surface-to-surface relation.

3. A sheet metal dunnage bar according to claim 1 or 2, wherein the strength characteristic of said working face is substantially equalled by the strength characteristic of said base portion.

4. A sheet metal dunnage bar according to claim 3, wherein said transverse web and pair of walls are formed by the medial portion of said strip.

5. A sheet metal dunnage bar according to claim 4, wherein said transverse web extends from the junction between one of said pair of walls and one of the sides of the dunnage bar to the junction between the other of said pair of walls and the other side of the dunnage bar.

6. The method of forming in successive stages from a single strip of sheet metal a tubular dunnage bar according to claim 1 comprising the steps of:

a. progressively forming the central portion of the sheet metal strip into a channel-shaped section having sides perpendicular to the side portions of the strip and a base parallel to the side portions;

b. progressively bending the sides of said channel section inwardly toward each other and in overlapping relation with the adjacent side portions of the strip while simultaneously forming the base of the channel section to the general configuration of said transverse web and creating a demarking bend inwardly from each side edge of the strip a distance approximately equal to the width of the base portion of the dunnage bar;

c. progressively forming a lip along one side edge of the strip and an indentation at each of said demarking bends while bending the portions of the strip between the side edges therof and said indentations inwardly toward each other;

d. folding the sides of the channel-shaped section and the adjacent side portions of the strip into surface-to-surface engagement to form said pair of walls and slot on the working face of the dunnage bar;

e. bending the side portions of the strip between said pair of walls and the indentations formed in step c. toward positions of perpendicular relation to the pair of walls to form the sides of the dunnage bar, while simultaneously continuing to bend the portions of the strip between the side edges thereof and said indentations toward each other; and, f. clinching the other side edge of the strip in the indentation inwardly of the lipped side edge, and interlocking the lipped side edge into the other indentation to form the double thicknesses of the base portion of the dunnage bar.

* * * * *